United States Patent [19]

Kita

[11] 4,351,415

[45] Sep. 28, 1982

[54] HYDRAULIC ELEVATOR INSTALLATION

[75] Inventor: Yasuo Kita, Nagoya, Japan

[73] Assignee: Shimadzu Corporation, Tokyo, Japan

[21] Appl. No.: 177,386

[22] Filed: Aug. 12, 1980

Related U.S. Application Data

[63] Continuation-in-part of Ser. No. 949,155, Oct. 6, 1978, abandoned.

[51] Int. Cl.[3] ..... B66B 1/26

[52] U.S. Cl. ..... 187/29 B

[58] Field of Search ..... 187/29

[56] References Cited

U.S. PATENT DOCUMENTS 2,565,880 8/1951 Pettengill et al. ..... 187/29 A

*Primary Examiner*—J. V. Truhe

*Assistant Examiner*—W. E. Duncanson, Jr.

*Attorney, Agent, or Firm*—George B. Oujevolk

[57] ABSTRACT

This invention provides a hydraulic elevator installation in which a variable hydraulic pump supplies pressure fluid to a hydraulic actuator connected to an elevator cage. The hydraulic pump functions to operate as a hydraulic motor with the pressure fluid discharged from the hydraulic actuator when the elevator is descending. The hydraulic pump is driven by an induction motor. The induction motor begins to function as an induction generator, recovering potential energy on the high speed rotation of the hydraulic motor while it is generating electricity. When the hydraulic pump has started its function as the hydraulic motor.

2 Claims, 4 Drawing Figures

HYDRAULIC ELEVATOR INSTALLATION

This application is a continuation-in-part of U.S. patent application Ser. No. 949,155 filed Oct. 6, 1978 now abandoned.

BACKGROUND OF THE INVENTION

The present invention relates to a hydraulic elevator and more particularly to a hydraulic power unit in the elevator installation for moving an elevator cage and controlling the up and down movement thereof.

BRIEF DESCRIPTION OF THE PRIOR ART

Generally speaking, the hydraulic elevator installation has been used only for stevedoring in comparatively low story warehouses, where the speed is slow and the elevating stroke is short, and some special use structures where the speed and elevating stroke are restricted in comparison with the traction type of elevators.

Together with the improvement of hydraulic technique in recent years, the hydraulic elevator has come to be deemed appropriate for small sized elevators in mult- and medium size buildings as it has the following structural and economic features:

(a) no machinery room is required on the rooftop;
(b) it requires less space to install and poses less weight on the beam of the building so that it can be installed on prefabricated buildings;
(c) It requires no counterweight and is more stable in case of earthquakes;
(d) It is easy to rescue passengers out of the elevator cage if there is a power failure or other trouble; and,
(e) Its installation and operating costs are low.

However, the noise produced by the hydraulic pump located in the power unit in the hydraulic system and control valves such as throttle valve and change-over valve remains one of the problems of hydraulic elevators.

For this reason, the screw pump which produces less noise during operation, in spite of its high costs has been used as the hydraulic pump and in the system, control valves to control the elevating speed are of the type where pressure fluid is drained off and the descending speed is controled by throttling the passage of pressure fluid.

Although improvements mentioned have been made, there is still the problem of the noise of the pressure fluid jetted out from the control valves which is large and cannot be prevented at this time. Apart from the problem of improvement of control valves, many improved types of silencers have been used to deaden the noise. However, no arrangement has as yet been found to completely silence the noise. Therefore, the problem of noise prevention, especially on control valves still remains to be solved.

From the standpoint of saving energy, a hydraulic system which uses less energy is needed in the field of hydraulic elevators.

As explained in U.S. Pat. No. 3,989,198, the temperature of the pressure fluid jetted out from control valves will rise and thus the heat energy is soon radiated losing much of the energy. In a hydraulic elevator the temperature rise of the pressure fluid will cause the elevator cage to stop at an offset position, that is to say it will stop either somewhat above or below the landing floor lowering the performance of the elevator.

OBJECT OF THE INVENTION

Accordingly, it is an object of the invention to provide a hydraulic elevator installation which recovers potential energy in operation.

SUMMARY OF THE INVENTION

In the hydraulic elevator installation contemplated herein, there are no control valves which function to drain some quantity of pressure fluid for controlling the speed of the elevator or for throttling the discharge passage of the pressure fluid, although a variable hydraulic pump which is capable of supplying properly adjusted pressure fluid into a cylinder housing a plunger connected to the floor of an elevator cage is provided. The hydraulic pump also functions to operate as a hydraulic motor to be driven with the pressure fluid discharged from the cylinder when the elevator cage is descending.

The hydraulic pump is driven by means of an induction motor. In the case when the hydraulic pump operates as a hydraulic motor when the elevator is descending, the induction motor is driven by the hydraulic motor at a rotational speed above the synchronous speed. In this case, the induction motor acts as an induction generator. This action is so-called "regenerative braking". The electric power generated may be collected by the power source or may be stored by means of a storage battery for later use. For example it may serve as the power source of an indicator for indicating the stopping position of the elevator.

Also, in the elevator contemplated herein, the up and down speed of the elevator cage is controlled by means of a variable hydraulic pump or motor capable of adjusting the quantity of discharge material or the suction pressure fluid of the pump or motor.

Further, the system of the hydraulic elevator installation described herein has the advantage that in the system there is rise in the temperature of the pressure fluid due to the fluid being jetted from the control valves as in a conventional system, thereby eliminating any loss of heat energy converted because of radiation and thus preventing any drop in the performance of the elevator so that the elevator functions properly for a long time.

Therefore, the hydraulic elevator installation of the present invention satisfies the requirement of saving energy.

Other features and advantages of the invention will become apparent from the following detailed description of the preferred embodiment of the invention with reference to the accompanying drawings, in which:

DETAILED DESCRIPTION

Figure 1:
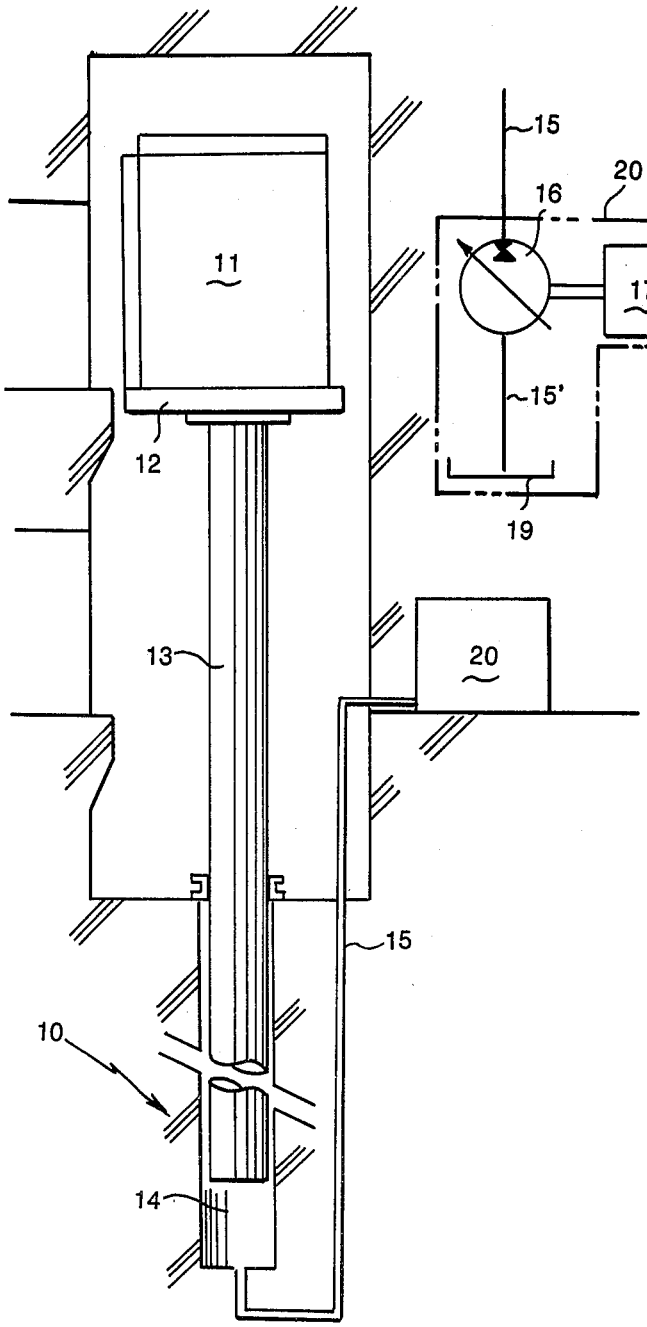
FIG. 1 shows a basic block diagram of a hydraulic elevator showing an embodiment of the invention.

As shown in FIG. 1, an elevator cage 11 for carrying passengers has a cage floor 12 supported on a plunger 13. The top of the plunger is slidably housed in a cylinder 14 embedded in the ground and the hydraulic jack 10 consists of the plunger and the cylinder 14. Therefore, the reciprocating movement up and down of the elevator cage is made by means of the hydraulic jack 10, that is, the plunger 13 moves up and down within the cylinder 14 by supplying pressure fluid into the cylinder 14 or by discharging pressure from the cylinder 14 so that the elevator cage is made to go up and down.

Supplying pressure fluid into cylinder 14 and discharging pressure fluid from the cylinder 14 is made by means of the hydraulic power unit 20 through the passage 15.

Figure 2:
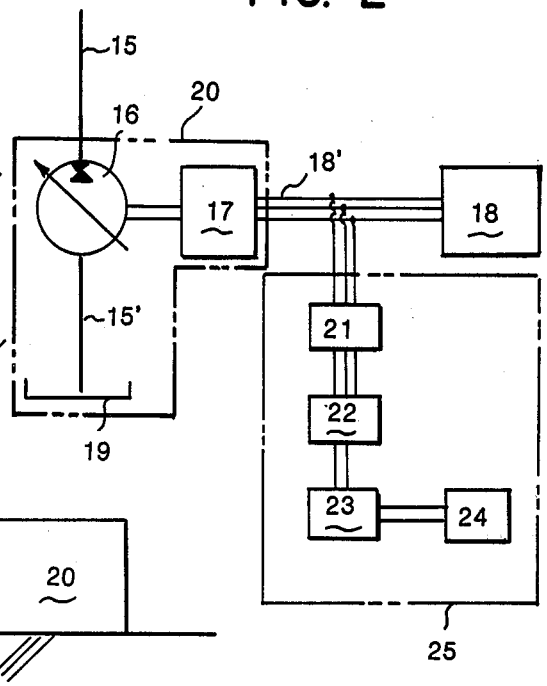
FIG. 2 is a detailed block diagram showing a power unit illustrated in FIG. 1.
Figure 3:
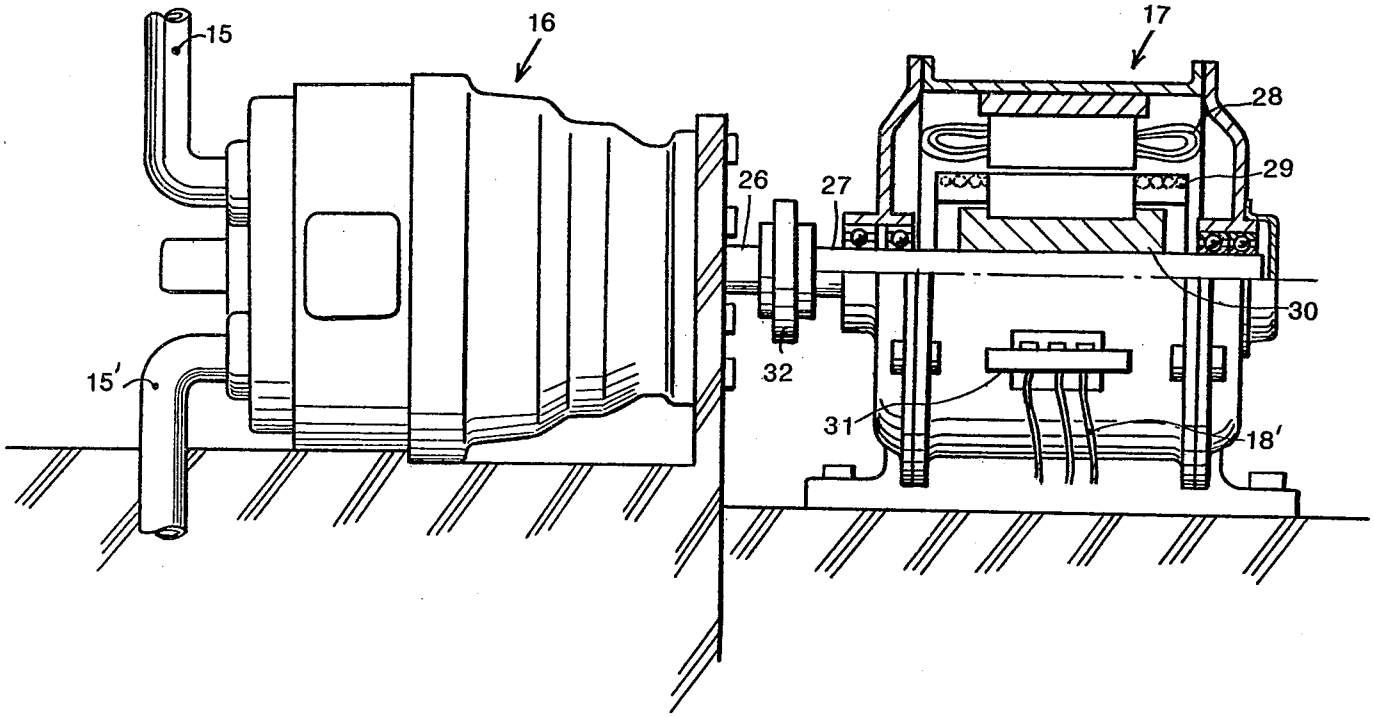
FIG. 3 illustrates an arrangement useful with the inventive concept contemplated herein; and, FIG. 4 graphically illustrates advantageous features of the arrangement described.

In FIG. 2, the hydraulic power unit 20 consists of these main structural components such as the variable hydraulic pump or motor 16, an induction motor 17 for driving the hydraulic pump 16, a power source 18 for driving the electric motor, and a fluid tank 19. In the arrangement shown there is an outlet passage 15 and an inlet passage 15'. The structural representation of the hydraulic pump or motor 16 is further shown in FIG. 3 illustrating the induction motor 17 and the connecting mechanisms.

As the variable hydraulic pump 16, for an example, the "Piston Pump" shown in U.S. patent application Ser. No. 819,763 filed on July 28, 1977, now U.S. Pat. No. 4,137,826 can be used, that is, the piston pump has a slide block slidably supported on closing means in the enclosed chamber of the pump together with a casing and a pintle in the chamber, mounted on the slide block. The slide block has a trapezoidal cross-sectional shape. On the other hand the pintle is formed with a member which has a circular truncated conical form and is attached to the slide block at the bottom of the cone. The conical periphery of the pintle has two oppositely situated arcuate grooves which communicated with an inlet passage and an outlet passage formed on the closing means.

Also on the pintle there is provided a cylinder block having plurality of cylindrical apertures in the conical periphery thereof in such a way that each cylindrical aperture is situated vertically with respect to the conical periphery of the truncated conical pintle. In each of the cylindrical apertures there is a piston, each piston is held between the cylinder block and a cylindrical holder having a plurality of flat faces in the interior wall thereof always in sealing contact with the outer end face of each piston. The cylinder block and cylindrical holder are driven to rotate integrally with each other by means of a common driven shaft.

At both end faces of the slide block there are disposed a couple of piston mechanisms opposite each other whose pressure force are different, the pressure force of these piston mechanisms is given by a high pressure fluid of discharge fluid, therefore, the slide block is forced to slide by being pushed by the piston mechanism having the larger pressure force against the pressure force of the other piston mechanism which has the smaller pressure force, resulting in becoming eccentric of the center of the pintle from the center of the driven shaft for rotating the cylinder block and cylindrical holder together therewith, the stroke of each piston being made in proportion to the eccentric distance.

In the piston mechanism, it is possible that the sliding distance of the slide block can be made to slide by means of the piston mechanism having a larger pressure force, thatis, the eccentric distance of the pintle can be adjusted by such a mechanism so that the piston mechanism having smaller pressure force can have its pressure force adjusted by manual means or the pressure of another fluid.

Therefore, a variable hydraulic pump 16 as described can regulate the quantity of discharge fluid which is supplied into the cylinder 14 by sliding the slide back so that the upward speed of the elevator cage 11 can be controlled.

The hydraulic pump 16 is driven as a hydraulic motor with the pressure fluid discharged from the cylinder 14 when the elevator cage 11 is descending. In general, it is well known that this type of piston pump or plunger type of hydraulic pump is capable of functioning as a hydraulic motor. In this case, therefore, the quantity of suction fluid which is discharged from the cylinder 14 can be regulated by sliding the slide block, so that the descending speed of the elevator cage 11 can be controlled.

When the hydraulic pump 16 operates as a hydraulic motor, it is necessary to form an eccentric angle between the pintle and the driven shaft by sliding the slide block to be turned in the opposite direction in order to make the rotational direction of the drive shaft of the hydraulic motor the same as the rotational direction when operated as a hydraulic pump 16, that is, the eccentric distance between the pintle and the driven shaft is zero when the center of the driven shaft coincides with that of the pintle, for example, of the eccentric direction between the pintle and the driven shaft is in the upper direction when the hydraulic pump 16 is operating as a pump, the adjustment is to be made in the opposite direction which is turned by 180° from the original position when the hydraulic pump is operating as a motor.

FIG. 3 shows the squirrel-cage 3-phase induction motor 17. In this motor, the squirrel-cage rotor 30 with secondary winding 29 rotates when the electric current from power source 18 flows into the primary winding 28 through the lead wires 18'. Lead wires 18' are fixed to the terminal 31 of the induction motor. A coupling device 32 is also used. The hydraulic pump 16 is driven by the induction motor 17. The drive shaft 27 of the induction motor is connected to the drive shaft 26 of the hydraulic pump 16. When the hydraulic pump 16 operates as a hydraulic motor, the induction motor 17 functions as an induction generator, driven at a speed over the synchronous speed by means of the hydraulic motor. When the elevator cage 11 is descending, the induction motor 17 functions to recover potential energy during the high speed rotation of the hydraulic motor 16 while it is generating electricity.

Figure 4:
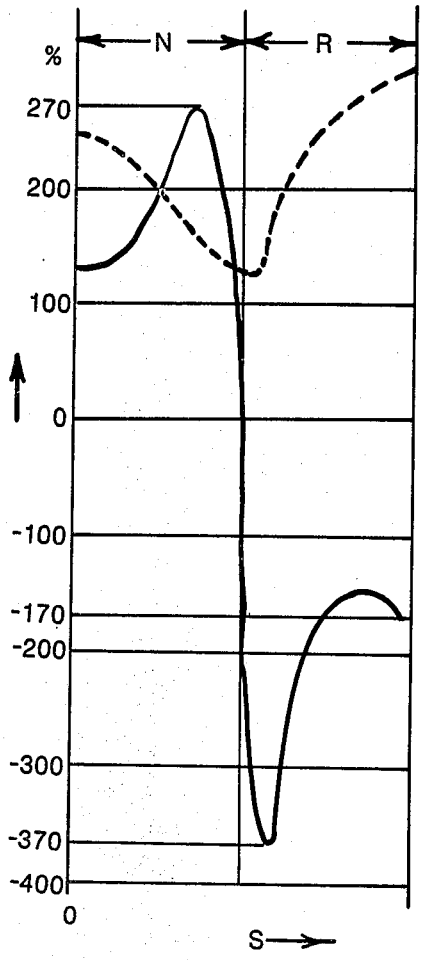

FIG. 4 describes the relation of the rotational speed to the ratio (%) of the rate torque to the turning torque of the induction motor.

The horizontal axis is the rotational speed and the vertical axis is the ratio. The solid line in FIG. 4 shows this relationship. The dotted line shows the electric current in the primary winding 28 of the induction motor. Area N is in the normal operation and area R is in the turning operation, or when the induction motor is rotated by pressure fluid flow from the elevator. The center line FIG. 4 shows synchronous speed. When the induction motor 17 is rotated by the high pressure fluid flow from the elevator, the rotational speed of the induction motor increases only 2 to 3% of the synchronous speed, therefore, the induction motor operates as a generator producing the rated voltage.

If the hydraulic motor 16 is operated so that the elevator descends as fast or slightly faster than it goes up, the induction motor 17 operates as a generator, without changing the direction of rotation. Of course, the fluid flow is in the opposite direction, but the bad influence of this change in the flow direction is compensated by the foregoing change in the function of the hydraulic motor 16.

The electric power generated by means of the induction motor 17 is accumulated by the circuit 25 or it is returned directly to the power source 18. In FIG. 2, the load circuit 25, for example, consists of a switch 21 which is turned "ON" only when the elevator cage 11 is going down, a rectifier 22, a storage battery 23, and an indicator 24 for indicating the floor at which the elevator cage 11 has stopped.

The operation of the hydraulic elevator installation of the present invention will now be explained, first, elevation of the elevator cage 11 can be made by moving upward the plunger 13 with the pressure fluid supplied into cylinder 14 from the fluid tank 19 through the passage 15 by means of the hydraulic pump 16 driven by induction motor 17. In this case, the elevating speed of the elevator cage 11 can be controlled, in case of using "Piston Pump" disclosed in U.S. patent application Ser. No. 819,763 as the hydraulic pump 16, by changing the quantity of discharge fluid which is suppied into the cylinder 14 by adjusting the eccentric distance between the pintle and driven shaft by sliding the slide block. In the same way as mentioned above, stopping of the elevator cage 11 at the landing floor required can be made by shutting off the supply of the pressure fluid into cylinder 14 by making the eccentric distance between the pintle and driven shaft "zero" by sliding the slide block. In this case, sliding of the slide block can be made easily with the pilot pressure made by converting an electric signal into a pressure signal.

The elevator cage is made to descend by having the drive shaft eccentric of the center of the pintle by sliding the slide block from the position where the eccentric distance between the pintle and the driven shaft is "zero" while the elevator 11 is stopped at a floor. In this case, the eccentric direction is turned by 180° from the position where the elevator is going up. Therefore, the hydraulic pump 16 functions as a hydraulic motor by means of the pressure fluid produced within the cylinder 14 and the pressure 15 due to the total potential energy of the loads effecting the plunger 13 such as the body weight of the passengers, empty weight of the elevator cage 11, the cage floor 12 and the plunger 13.

On the other hand, the induction motor 17 is still connected to the power source 18 in case the elevator is going down and it is driving the hydraulic pump 16. However, the induction motor 17 functions to operate as an induction generator and thus it will apply the brake on the high speed rotation of the hydraulic motor while generating electricity by setting the rotational speed of the hydraulic motor 16 at a speed over the synchronous speed of the induction motor 17, resulting in descending or lowering the elevator at the desired speed. The descending speed of the elevator can be controlled by changing the quantity of suction fluid which is discharged from the cylinder 14 by adjusting the eccentric distance between the pintle and the driven shaft in the same was as the control of the upward speed. Also the stopping of the elevator at a floor can be controlled in the same way.

The electric power generated need not be used as shown in FIG. 2 but can be returned to the power source 18 and stored there.

I claim:

1. A hydraulic elevator installation comprising:

(a) an elevator cage (11);

(b) a hydraulic actuator, including a cylinder (14) having a plunger (13) connected to said elevator cage (11);

(c) a hydraulic pump (16) having a variable output for supplying said hydraulic actuator with pressure fluid wherein said pump (16) functions to operate as a hydraulic motor, driven with the pressure fluid discharged from said cylinder (14) when said elevator cage (11) is descending, said pump being adjustable to maintain the rotational direction of a drive shaft of the pump the same during ascending and descending of said elevator cage;

(d) an induction motor (17) for driving said hydraulic pump (16), wherein said induction motor (17), when driven at a speed over the synchronous speed by means of said hydraulic motor (16) functions to operate as an induction generator; and, (e) a power source (18) for driving said induction motor (17).

2. In a hydraulic elevator installation, having an elevator cage (11), with a cage floor (12), a hydraulic actuator, including a vertical plunger (13) connected to the cage floor with a vertical cylinder (14) housing said plunger, a hydraulic pump (16) having a variable output coupled to said hydraulic actuator for supplying said hydraulic actuator with pressure fluid, and an electric motor coupled to said pump, the improvement wherein;

(a) said variable hydraulic pump is a piston pump with a slide block and pintle mounted on said slide block, said pump being adjustable to maintain the rotational direction of a drive shaft of the pump the same during ascending and descending of said elevator cage; and, (b) said electric motor (17) is an induction motor, whereby said pump functions as a hydraulic motor driven by hydraulic fluid discharged from said cylinder; and, said induction motor becomes a generator; and, (c) a load circuit (25) coupled to said induction motor.

* * * * *